US006936120B1

(12) United States Patent
Gaudre et al.

(10) Patent No.: US 6,936,120 B1
(45) Date of Patent: Aug. 30, 2005

(54) SEMI-CONTINUOUS TWO-PACK PROCESS FOR CASTING SOLID PROPERGOL PASTE

(75) Inventors: Marie Gaudre, Le Haillan (FR); Eric-Serge Giraud, Bordeaux (FR); Jean-Michel Tauzia, Blanquefort (FR)

(73) Assignee: SNPE Materiaux Energetiques, Paris (FR)

( * ) Notice: Subject to any disclaimer, the term of this patent is extended or adjusted under 35 U.S.C. 154(b) by 208 days.

(21) Appl. No.: 10/345,207

(22) Filed: Jan. 16, 2003

(30) Foreign Application Priority Data

Feb. 1, 2002 (FR) ..... 02 01214

(51) Int. Cl.[7] ..... C06B 45/10; D03D 23/00
(52) U.S. Cl. ..... 149/19.92; 149/109.6
(58) Field of Search ..... 149/19.92, 109.6; 264/3.1

(56) References Cited

U.S. PATENT DOCUMENTS

| | | | | |
|---|---|---|---|---|
| 4,191,480 A | | 3/1980 | Hiorth | |
| 4,517,035 A | * | 5/1985 | Duchesne et al. | 149/19.92 |
| 5,529,212 A | | 6/1996 | Terhardt | |
| 5,739,252 A | | 4/1998 | Kirchmeyer et al. | |
| 5,942,720 A | * | 8/1999 | Doll et al. | 149/19.92 |

FOREIGN PATENT DOCUMENTS

| | | |
|---|---|---|
| DE | 41 15 201 A1 | 1/1992 |
| DE | 43 13 171 A1 | 10/1994 |
| EP | 0 553 476 A1 | 8/1993 |
| GB | 1 605 257 | 9/1986 |
| WO | WO 92/22377 | 12/1992 |
| WO | WO 01/72861 A2 | 10/2001 |

* cited by examiner

*Primary Examiner*—Aileen Felton
(74) *Attorney, Agent, or Firm*—Oliff & Berridge, PLC

(57) ABSTRACT

A process for casting propellant paste into a mould to manufacture a block of solid propellant includes first mixing two groups of components briefly at low pressure, mixing the two groups of components at high pressure, and casting the mixture in a mould. The first group of components represents about 80% to about 99% of the finished product and essentially comprises a liquid prepolymer, at least one pulverulent solid charge and some of the various additives of the propellant paste. The second group of components represents about 20% to about 1% of the finished product and comprises the crosslinking agent and the rest of the additives.

11 Claims, 1 Drawing Sheet

SEMI-CONTINUOUS TWO-PACK PROCESS FOR CASTING SOLID PROPERGOL PASTE

Figure 1:
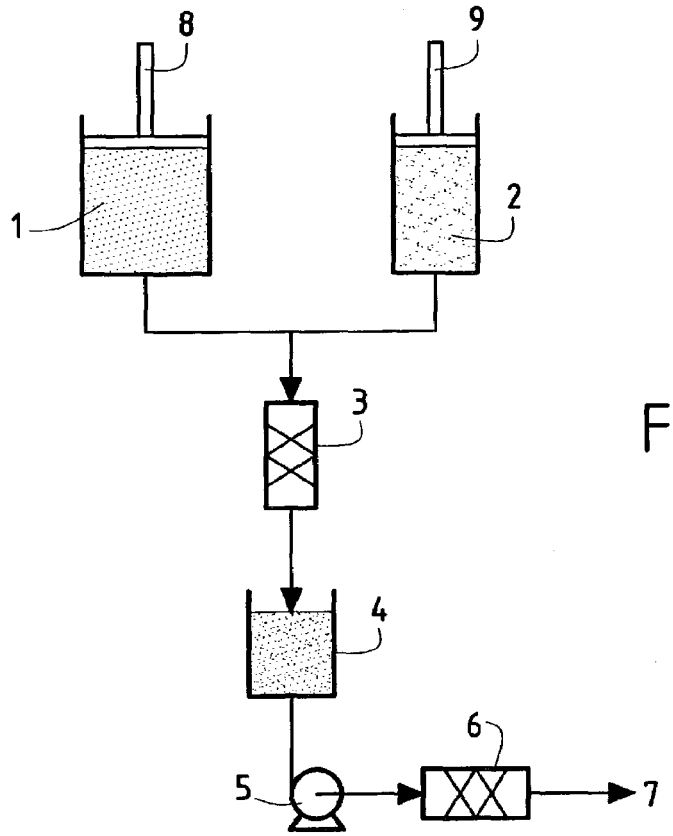

The present invention relates to the field of blocks or charges of solid propellant.

More particularly, the invention relates to a process for preparing and casting a propellant paste, of composite type, in a mold for preparing a block or a charge of solid propellant. The invention applies especially to the manufacture of large charges for space launchers.

A solid propellant of composite type comprises a solid polymer matrix or binder, pulverulent solid charges, such as oxidizing agents, optionally reducing agents and/or energetic agents and also various feasibility and performance additives.

The binder is prepared from a liquid polymerizable resin with chemically reactive end groups, which will be crosslinked by means of at least one liquid crosslinking agent. The various ingredients of the propellant, and then the crosslinking agent, are introduced into the liquid resin, in a suitable order. On hardening of the resin by curing at a temperature that is compatible with the presence of pyrotechnic materials, it coats all of the ingredients and especially the pulverulent charges to form a solid.

The ingredients are chosen so as to ensure combustion of the propellant to produce gases. This combustion generally takes place by parallel layers; that is, the speed of regression of the flame front is from a few millimeters per second to a few centimeters per second.

Further details regarding the various ingredients forming part of the composition of propellants of composite type will be found, for example, in DAVENAS "Technologie des propergols solides [Technology of solid propellants]", chapters 10 and 11, Masson 1989.

The process currently used to manufacture such blocks is a "batch" process, which consists of preparing a certain quality of product and of casting a certain number of charges.

In a first step, the various ingredients are introduced in a suitable order. The ingredients are blended carefully over a long time, under very specific temperature and pressure (generally under vacuum) conditions. For the next step, this mixture, which is in the form of a paste, is cast in a mold with shaping tools. The assembly is cured to harden the paste. In certain cases, the mold constitutes the actual envelope of the propellant, this envelope being suitably prepared for the production of the charge.

The crosslinking agent is introduced into the mixture towards the end of the blending step. The paste then begins to harden. The casting can only be performed for a limited time, known as the pot life, during which the mixture remains fluid enough to be cast. It is therefore necessary for the casting in the mold to follow the end of the blending step as quickly as possible; this furthermore involves making a compromise between the pot life and the duration of the curing operation.

For the manufacture of large charges, from a few tens to a few hundreds of tons, generally used in the aerospace field (accelerators attached to the launcher), a sequence of several blends-casts needs to be set up in the same envelope. The sequence of blends and casts must be set up in a precise and rigorous manner. An economic choice between the size of blenders available and that of the charge must also be made. In all cases, the manufacturing cycle is long and expensive since there is considerable immobilization of the materials and personnel during the manufacture.

One solution to the problem of the pot life, in the case of the manufacture of small objects, is suggested by a semi-continuous two-pack process described by J. M. Tauzia in "Some comments on processing energetics materials—Compatibility and Processing Symposium—ADPA-23–25 October 1989 (at Virginia Beach).

The process described in the Tauzia article consists of separating the composition into two groups of components of equivalent viscosity that are then mixed together, in a mass ratio of close to 1/1, just before casting in the mold. One of the groups of components comprises the polymer that constitutes the binder, half of the pulverulent charges and certain additives; the other group of components comprises the crosslinking agent, which is also in polymer form, the other half of the pulverulent charges and the rest of the additives. These two groups of components are chemically stable when they are separate.

However, this process has several drawbacks. The two groups of components each comprise half of the pulverulent charges and thus pyrotechnic ingredients. Also, the two groups of components must be prepared and stored in suitable installations that satisfy strict security standards (hereinbelow, secure installations).

Moreover, it is difficult to produce a homogeneous mixture of these two groups of components, which are viscous.

Lastly, the final composition obtained is different from that of the "batch" process, especially with regard to the binder. The two-pack process forms the binder from the mixture of two polymers; thus, the propellant obtained must undergo a further approval for the intended use. This is a long and expensive operation.

The two-pack process with a mixture in a 1/1 ratio of two groups of components is therefore not entirely satisfactory, and does not appear to be easily applicable to the manufacture of large charges.

The aim of the present invention, adopting a two-pack technique, is to solve the problems posed above.

The present invention thus relates to a semi-continuous two-pack process for casting propellant paste in a mold to manufacture a block of solid propellant by curing the paste. The paste comprises a liquid prepolymer, a liquid crosslinking agent, at least one pulverulent solid charge and various additives. The casting is performed using the mixture of two groups of components, and the process is characterized in that the first group of components represents about 80% to about 99% of the finished product and comprises essentially the prepolymer, all the pulverulent solid charges and some of the additives; and that the second group of components represents about 20% to about 1% of the finished product and comprises all the crosslinking agent and the remainder of the additives. The additives will especially comprise some of the propellant plasticizer. It may also be stated that the mass ratio of the mixture of the two groups of components is between 80/20 and about 99/1.

Preferably, the first group of components represents about 90% to about 99% of the finished product, and the second group of components represents about 10% to about 1% of the finished product. The mass ratio of the mixture of the two groups of components is between about 90/10 and about 99/1.

The propellant binder may be obtained from a carboxytelechetic polybutadiene or, preferably, from a hydroxytelechetic polybutadiene crosslinked in the latter case with an isocyanate in monomer form. The binder may also be obtained from a substituted oxetane or oxirane prepolymer; from nitramine or nitrate polymer; from polyester or from polyether.

The pulverulent charges comprise at least one oxidizing charge chosen from the group of non-organic nitrates or perchlorates, for example ammonium nitrate or ammonium perchlorate. Some of these oxidizing pulverulent charges may be replaced with energetic charges such as nitramines, for example octagon or hexagon.

Finally, the pulverulent charges may also comprise, in order to increase the performance qualities of the propellant, reducing charges in the form of metal powder, for example aluminum.

The various additives usually used for manufacturing propellants also include the plasticizer and the crosslinking catalyst, the natures and contents of which may have advantageous effects in the present invention, as will be seen hereinbelow.

The choice of the plasticizer and of its contents in the first group of components especially avoids the problems of settling of the solid charges in the course of the storage of this group of components.

Advantageously, the second group of components comprises only the liquid crosslinking agent in monomer form, without any of the propellant additives, which are all incorporated in the first group of components.

According to a first variant of this process, the mixing is performed in two steps:

- a first step of setting the ratio of the first group of components to the second group of components to the right amount, by means of precise metering of the two groups of components in the desired mass ratio, and briefly mixing the two groups of components,
- a second step of homogenization mixing, during which the above brief mixture is mixed thoroughly, before casting into the mold.

Advantageously, the two mixing steps are separated by passing the mixture into a buffer tank, before taking it up for the homogenization mixing. The residence time in the buffer tank is as short as possible.

The two mixing steps are performed by any suitable means, but are preferably performed by means of static mixers.

Preferably, the mixing of the first step is performed at low pressure and the homogenization mixing is performed at high pressure.

The separation of the two steps by passing the mixture into a buffer tank makes it possible to take up the mixture at high pressure to perform the step of homogenization mixing and of the casting the paste with a high flow rate. This high flow rate is necessary for the casting, under satisfactory economic conditions, of large charges. Increasing the pressure of the mixture is performed by means of a pump placed at the outlet of the buffer tank.

Advantageously, the mixing of the first step is performed at low pressure of between about 0.006 MPa and about 1 MPa; and the homogenization mixing is performed at high pressure of between about 2 MPa and about 2.5 MPa.

Also advantageously, the homogenization mixing is performed at a propellant paste curing temperature of between about 20° C. and about 80° C. The expression "curing at about 20° C."should be understood simply as meaning maintaining the temperature of the propellant paste at room temperature. The curing temperature may be lowered by increasing the content of crosslinking catalyst among the additives. The mixing and casting at the same temperature as the curing temperature has the advantage of limiting the problems of thermal shrinkage.

According to a second variant of the process, the two groups of components are mixed together in a single step. In this case also, the mixing is performed by any suitable means, but is preferably performed in a static mixer set with the desired mass ratio. The static mixer operates at high pressure, of between 2 MPa and about 2.5 MPa. Adantageously, the mixing is performed, as previously, at the propellant paste curing temperature of between about 20° C. and about 80° C. This curing temperature may be lowered towards the lower limit by increasing the content of crosslinking catalyst.

This invention essentially characterized by a particular choice of the two groups of components that will be mixed together in a precise mass ratio to resolve the problems left unanswered by the two-pack process of the prior art.

This process of course retains the advantage of the two-pack process, namely that of dispensing with the pot life.

The blending sequences to prepare the two groups of components are entirely independent of the sequences for mixing and casting the said components, which may take place a very long time after these two groups of components have been prepared.

Only the first group of components, which contains all the pulverulent charge, and thus the pyrotechnic products, needs to be prepared with care and stored in secure installations. The second group of components, which may amount to the crosslinking agent alone, is prepared and stored under very simple conditions.

Moreover, the second group of components is essentially liquid and mixes without problem with the first group of components, which itself is in the form of a paste.

This makes it possible to readily adapt the pressure and flow rate conditions to the time of casting of a large charge. This therefore considerably reduces the duration and cost of the manufacturing cycle.

Finally, in the process of the invention, since the crosslinking agent is introduced in the form of a liquid monomer, the binder obtained will be identical to that of the "batch" process, and thus since the final composition will be the same, the propellant will not need to be approved again, which considerably reduces the costs.

The invention will be described in greater detail with the aid of FIGS. 1 and 2, which represent in a very schematic manner examples of installations for carrying out the two variants of the process.

FIG. 1 describes an installation for carrying out the invention according tot a first mode in two separate steps.

Figure 2:
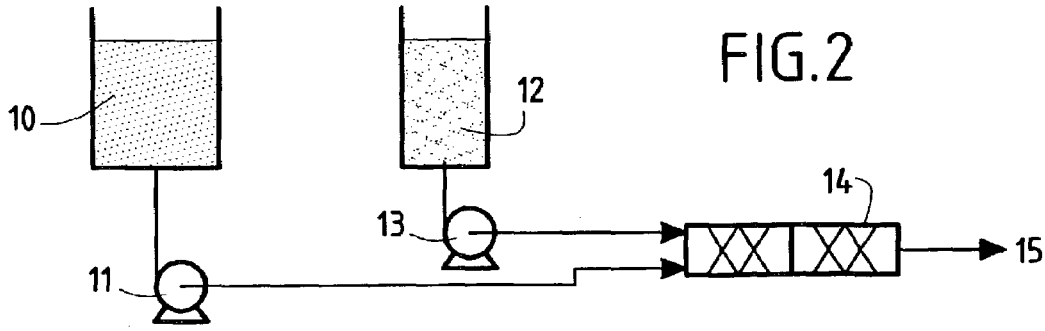

FIG. 2 describes an installation for carrying out the invention according to the second mode in a single step.

These two variants of the process of the invention assume the prior preparation of the two groups of components.

Firstly, the second group of components, which essentially comprises the liquid crosslinking agent in monomer form and optionally some of the additives, is very simple to prepare. For example, it involves mixing with mechanical stirring. This group of components represents only a small mass of the finished product, and a single tank will be sufficient to store it.

In contrast, the first group of components, which comprises the liquid prepolymer, all of the pulverulent solid changes and the additives, must be prepared with the same precautions and care as a propellant. The mixture constituting this group of components is chemically stable since there is no crosslinking agent; a suitable choice of plasticizer prevents settling of the solid charges and allows this mixture to be stored for a long time in suitable secure installations.

The first group of components represents the majority of the finished product and, in the case of a large charge (for example 100 tons), a large amount of product that needs to be prepared by several blends and stored in several tanks, given the sizes of the blenders and tanks available.

FIG. 1 shows very schematically an installation for carrying out the process of the invention according to a first variant.

Tanks 1 and 2 containing the first and second groups of components, respectively, feed a static mixer 3.

On the tanks 1 and 2, the pistons 8 and 9, driven by a mechanism that is not shown, feed the first and second groups of components, respectfully, in the desired mass ratio into the static mixer 3, which performs a brief mixing of the two groups of components set to the desired ratio, and feeds a buffer tank 4. At the outlet of the buffer tank, a pump 5 raises the pressure of the mixture to feed a static mixer 6, working at high pressure, the outlet 7 of the mixer directly feeding the casting mold.

For the manufacture of a large charge, the required amount of mixture of the first group of components exceeds the capabilities of a single tank. It suffices to have available several tanks of the type 1 on the feed into the static mixer 3 and, via a special valve system, to deplete the mixture successively in the tanks.

FIG. 2 shows very schematically an installation for carrying out the process according to a second variant.

The tanks 10 and 12 contain the first and second groups of components, respectively. Pumps 11 and 13, working at high pressure and the flow rates of which are in the desired mass ratio, feed a static mixer 14, the outlet 15 of which directly feeds the casting mold.

The metering and pressurization pumps are chosen from standard equipment, such as either peristaltic pumps or screw pumps (for example of the Steible brand), or alternating twin-piston pumps (for example of the Putzmeister brand) or pistons placed directly on the tanks of the two groups of components.

The static mixers are pipes containing cross braces that oblige the paste passing therethrough to become separated and to remix. These pipes are sized in diameter as a function of the flow rate and the number of unit elements ensures the quality of mixing as a function of the available pressure. 4 unit elements are used for low-pressure mixing and up to 12 unit elements are used for high-pressure mixing. A mixer consisting of jacketed unit elements makes it possible, by circulating a suitable heat-exchange fluid, to heat the propellant paste to the desired casting temperature.

The mechanical properties of the propellant manufactured by the process of the present invention were measured for a propellant whose polymer matrix based on a hydroxytelechetic polybutadiene resin represents 14% by mass of the finished product, containing 82% by mass of ammonium perchlorate and 4% by mass of aluminum. The density is 1.72, the Young's modulus is between 5 and 7 MPa and the breaking strength is 1.1 MPa. These values are comparable with values obtained by the "batch" process.

What is claimed is:

1. A semi-continuous two-pack process for making a block of solid propellant, comprising:

mixing a first group of components and a second group of components to form a mixture;

casting the mixture in a mould;

wherein the first group of components represents about 80% to about 99% of the finished product and comprises essentially a liquid polymer, at least one pulverulent solid charge and at least one additive;

wherein the second group of components represents about 20% to about 1% of the finished product and comprises a crosslinking agent; and wherein the first group of components and the second group of components are separately mixed prior to the mixing step.

2. The process according to claim 1, wherein the first group of components represents about 90% to about 99% of the finished product and the second group of components represents about 10% to about 1% of the finished product.

3. The process according to claim 1, wherein the second group of components comprises the crosslinking agent and at least one additive.

4. The process according to claim 1, wherein the mixing step comprises:

setting the ratio of the first group of components to the second group of components to the right amount, by means of precise metering of the two groups of components;

mixing the first group of components and the second group of components under low pressure to form the mixture;

passing the mixture into a buffer tank;

homogenization mixing of the mixture.

5. The process according to claim 4, wherein the mixture is passed into a buffer tank between the mixing and homogenization mixing steps.

6. The process according to claim 4, wherein the mixing step is performed in a static mixer and the homogenization mixing step is performed in a static mixer.

7. The process according to claim 4, wherein the mixing step is performed at a pressure between 0.006 MPa and 1 MPa.

8. The process according to claim 4, wherein the homogenization mixing step is performed at a pressure between 2 MPa and 2.5 MPa.

9. The process according to claim 8, wherein the homogenization mixing step is performed at a curing temperature of between 20° C. and 80° C.

10. The process according to claim 1, wherein the mixing step is performed in a static mixer at high pressure.

11. The process according to claim 10, wherein the mixing step is performed at a curing temperature of between 20° C. and 80° C.

* * * * *